United States Patent [19]

Struve et al.

[11] Patent Number: 4,705,666

[45] Date of Patent: Nov. 10, 1987

[54] ALKANOLAMIN SALTS OF ALKENYL SUCCINIC ACID DIALKYL SEMIAMIDE CORROSION INHIBITORS

[75] Inventors: Alfred Struve, Hilden; Horst Upadek, Ratingen; Juergen Geke, Duesseldorf, all of Fed. Rep. of Germany

[73] Assignee: Henkel Kommanditgesellschaft auf Aktien, Duesseldorf, Fed. Rep. of Germany

[21] Appl. No.: 666,408

[22] Filed: Oct. 30, 1984

[30] Foreign Application Priority Data

Nov. 12, 1983 [DE] Fed. Rep. of Germany ..... 3341013

[51] Int. Cl.[4] ..... C23F 11/04; C07C 83/00; C09K 3/00

[52] U.S. Cl. ..... 422/16; 252/392; 260/501.17

[58] Field of Search ..... 252/392; 260/501.17; 422/16

[56] References Cited

U.S. PATENT DOCUMENTS

| | | | |
|---|---|---|---|
| 2,490,744 | 12/1949 | Trigg et al. | 252/34 |
| 3,251,776 | 5/1966 | Gee et al. | 252/392 |
| 3,427,245 | 2/1969 | Hotten | 252/392 |
| 3,458,444 | 7/1969 | Shepherd et al. | 252/392 |
| 3,525,693 | 8/1970 | Lyle et al. | 260/501.17 |
| 3,544,467 | 12/1970 | Kautsky | 260/501.17 |
| 3,546,151 | 12/1970 | Baker et al. | 260/28.5 |
| 3,762,873 | 10/1973 | Alink | 252/392 |
| 4,192,769 | 3/1980 | Jahuke | 252/392 |
| 4,207,285 | 6/1980 | Oppenlaender et al. | 422/16 |
| 4,253,876 | 3/1981 | Godar et al. | 252/392 |
| 4,388,199 | 6/1983 | Brandolese | 252/392 |
| 4,473,491 | 9/1984 | Trautmann et al. | 252/392 |
| 4,552,678 | 11/1985 | Cargnino et al. | 260/501.15 |
| 4,609,531 | 9/1986 | Ritschel et al. | 260/501.17 |

FOREIGN PATENT DOCUMENTS

| | | | |
|---|---|---|---|
| 2780 | 11/1980 | European Pat. Off. . | |
| 2943963 | 10/1979 | Fed. Rep. of Germany . | |
| 2048262 | 12/1980 | United Kingdom | 260/501.17 |

*Primary Examiner*—J. E. Evans

*Attorney, Agent, or Firm*—Ernest G. Szoke; Henry E. Millson, Jr.; Real J. Grandmaison

[57] ABSTRACT

The $C_{2-4}$-alkanolamine salts of alkenyl succinic acid dialkyl semiamides are used as corrosion inhibitors in aqueous systems.

6 Claims, No Drawings

ALKANOLAMIN SALTS OF ALKENYL SUCCINIC ACID DIALKYL SEMIAMIDE CORROSION INHIBITORS

BACKGROUND OF THE INVENTION

1. Field of the Invention

The $C_{2-4}$-alkanolamine salts of alkenyl succinic acid dialkyl semiamides are used as corrosion inhibitors in aqueous systems.

2. Statement of the Related Art

Numerous derivatives of succinic acid have already been proposed as corrosion inhibitors. Thus, U.S. Pat. No. 2,490,744 describes reaction products of alkenyl succinic acid anhydrides with primary amines in a molar ratio of 1.25–2:1 as rust inhibitors in lubricating oils and certain organic solvents, the total number of carbon atoms in 2 mols of the anhydride and 1 mole of the amine being between 28 and 50.

Reaction products of alkenyl succinic acid anhydrides with long-chain dialkylamines are similarly known for use in the oil phase. U.S. Pat. No. 3 546 151 describes inter alia the reaction products with excess ditallow amine. The wax-like succinic acid semiamide amine salts obtained may be used as corrosion inhibitors in water-repellent media.

The use of alkanolamine salts of $C_8$–$C_9$-alkenyl succinic acid for rust prevention in purely aqueous systems is known from German Patent Application No. 29 43 963.

In addition, the use of amidomaleic acid alkanolamine salts containing a $C_8$–$C_{12}$-isoalkyl group on the amide radical as corrosion inhibitors in aqueous systems is described in European Pat. No. 2,780.

The proposed alkanolamine salts of $C_{8-9}$-alkenyl succinic acid or amidomaleic acid are distinguished by the fact that they only foam to a minimal extent. However, their anticorrosive properties are unsatisfactory.

U.S. Pat. No. 4,207,285 discloses modified maleic acid corrosion inhibitors for aqueous systems, including the triethanolamine salt of maleic acid mono-2-ethylhexylamide. The corresponding succinic acid compound is used in a comparative example and is disclosed as unsatisfactory. None of the disclosed compounds are alkenyl substituted.

DESCRIPTION OF THE INVENTION

This invention affords corrosion inhibitor additives for use in aqueous systems which show comparatively excellent activity, consisting of at least one alkanolamine salt of a compound, having the formula:

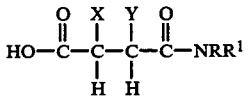

(I)

wherein:

one of X or Y is H and the other is a $C_{6-18}$-alkenyl, preferably a $C_{8-18}$-alkenyl, most preferably a $C_{10-18}$-alkenyl;

R and $R^1$ are each a $C_{1-10}$-alkyl, preferably a $C_{3-8}$-alkyl, which may be the same or different, and are preferably the same.

The compounds of this invention exhibit only minimal foaming and are adequately soluble in water. As a result, they are particularly useful as corrosion inhibitors in aqueous media. They may be used singly or in any mixture thereof.

Other than in the operating examples, or where otherwise indicated, all numbers expressing quantities of ingredients or defining ingredients or reaction conditions used herein are to be understood as modified in all instances by the term "about."

The compounds used may be produced by reacting maleic acid anhydride with $C_{6-18}$-alkenes to form alkenyl succinic acid anhydrides which, in turn, are reacted with dialkylamines, comprising two $C_{1-10}$-alkyl radicals in a molar ratio of 1:1 at araound 70° to 90° C. to form the corresponding semiamide monoacids.

The salts of the semiamide acids are obtained by the addition of equimolar or excess quantities of at least one alkanolamine. It is best to use $C_{2-4}$-alkanolamines, preferably mono-, di-, or tri-ethanolamine.

Any commercially available olefins may be used for producing the alkenyl succinic acid anhydride intermediate. Thus, it is possible to use $\alpha$-olefins, olefins containing an internal double bond and olefin mixtures which also contain vinylidene olefins, i.e., $\alpha$-olefins with two substituents on the $\beta$C-atom. The reaction with the amines is carried out in equimolar ratios or even with a slight excess of anhydride. The dialkylamines, may be used to afford the $NRR^1$ moiety, may be linear or branched.

The compounds obtainable in this way ma be used either on their own or in combination with known other compounds as water soluble anticorrosive constituents in rustproofing agents, in industrial cleaning preparations for use in metal working, and in cooling lubricants.

The corrosion inhibitors according to the invention may be used in known manner in any amount which is corrosion inhibitive effective. More specifically, they are used in concentrations of 0.01 to 15% by weight, preferably 0.05 to 1% by weight, based on the weight of the media, and are expressed in each case as the alkenyl succinic acid semiamide.

The invention is illustrated, but in no way limited, by the following Examples.

EXAMPLE 1

Production Method 852 g (8.7 mols) of maleic acid anhydride and 1830 g (10.9 mols) of 1-dodecene are first heated to reflux temperature and thereafter to a temperature of approximately 230° C. in the presence of 9.1 g of 2,6-di-tert.-butyl-4-methylphenol. After stirring for approximately 2 hours at 230° C., the reaction mixture is cooled, the excess olefin is distilled off in vacuo and the dodecenyl succinic acid anhydride left as residue is freed from polymeric particles by filtration. Yield: 1829 g (70% of theoretical), saponification number 430.

236 g (0.9 mol based on the saponification number) of dodecenyl succinic acid anhydride are heated under nitrogen to 50° C., followed by the addition of 116 g (0.9 mol) of dibutylamine, during which the temperature may rise to around 90° C. On completion of the addition, the mixture is stirred for about another hour at 100° C. After cooling, dodecenyl succinic acid monodibutylamide is obtained in the form of a clear, highly viscous substance.

Yield: 352 g (quantitative), acid number: 148 (theoretical: 143).

The semiamide is converted into the alkanolamine salts by gentle heating with excess mono-, di- or tri-ethanolamine in the presence of a little water.

EXAMPLE 2

The following succinic acid semiamides and their alkanolamine salts were produced by the method described in Example 1.

1. Decenyl succinic acid mono-diisopropyl amide
2. Dodecenyl succinic acid mono-dibutylamide
3. $C_{14/16}$-alkenyl succinic acid mono-dibutylamide*
4. $C_{14/16}$-alkenyl succinic acid mono-dipropylamide*
5. $C_{14/16}$-alkenyl succinic acid mono-di(2-ethylhexyl)-amide*
6. Hexadecenyl succinic acid mono-dibutylamide
7. Isomer-$C_{15/18}$-alkenyl succinic acid mono-dibutylamide**

*Starting material $\alpha$-$C_{14/16}$-olefins containing approximately 19% of vinylidene olefins

**Olefin (mixture) containing a internal double bond

EXAMPLE 3

Performance Testing

The compounds of Examples 1 and 2 were tested in the form of their mono-, di- and tri-ethanolamine salts using the gray cast iron filter test according to Deutsche Industrienorm (DIN) 51,360. Water having a hardness of 20° d prepared in accordance with the above DIN was used as the test medium. Each test within the series to be compared was carried out at a constant pH (8.0 to 9.5).

The results were evaluated in accordance with DIN 51,360 using the following corrosion scale:

0=no corrosion
1=traces of corrosion
2=slight corrosion
3=moderate corrosion
4=serious corrosion The test results are set out in the following Table.

TABLE 1

| | Alkanolamine salt: | | | | | | | | |
|---|---|---|---|---|---|---|---|---|---|
| | Monoethanolamine salt | | | Diethanolamine salt | | | Triethanolamine salt | | |
| | Inhibitor concentration (% by weight): (based on the alkenyl succinic acid semiamide used) | | | | | | | | |
| | 0.25 | 0.375 | 0.5 | 0.25 | 0.375 | 0.5 | 0.25 | 0.375 | 0.5 |
| 1. Decenyl succinic acid mono-diisopropylamide | 0 | 0 | 0 | 2 | 0 | 0 | 3 | 2 | 0 |
| 2. Dodecenyl succinic acid mono-dibutylamide | 0 | 0 | 0 | 1 | 0 | 0 | 2 | 1 | 0 |
| 3. $C_{14/16}$—alkenyl succinic acid mono-dibutylamide | 0 | 0 | 0 | 0 | 0 | 0 | 3 | 1 | 0 |
| 4. $C_{14/16}$—alkenyl succinic acid mono-dipropylamide | 0 | 0 | 0 | 2 | 0 | 0 | 4 | 1 | 0 |
| 5. $C_{14/16}$—alkenyl succinic acid mono-di(2-ethylhexyl)amide | 2 | 0 | 0 | 3 | 0 | 0 | 4 | 3 | 3 |
| 6. Hexadecenyl succinic acid mono-dibutyl amide | 0 | 0 | 0 | 3 | 0 | 0 | 3 | 1 | 0 |
| 7. Isomer-$C_{15/18}$—alkenyl succinic acid mono-dibutylamide | 0 | 0 | 0 | 1 | 0 | 0 | 4 | 3 | 1 |
| Comparison 1: caprylic acid | 3 | 2 | 1 | 4 | 3 | 2 | 4 | 4 | 3 |
| Comparison 2: maleic acid mono-(2-ethylhexyl)-amide | 0 | 0 | 0 | 1 | 1 | 1 | 3 | 1 | 0 |
| Comparison 3: $C_{8-9}$—alkenyl succinic acid | 4 | 4 | 4 | 4 | 4 | 4 | 4 | 4 | 4 |

We claim:

1. A method of inhibiting corrosion in aqueous system comprising adding to said system a corrosion inhibitive effective amount of at least one $C_2$–$C_4$-alkanolamine salt of a compound of the formula:

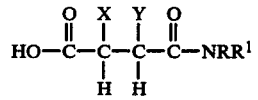

wherein: one of X or Y is H and the other is a $C_{10-18}$-alkenyl; and R and $R^1$ are each the same $C_{3-8}$-alkyl; said salt being present in an amount of about 0.1 to 15% by weight of the semiamide acid, based upon the weight of said aqueous system.

2. The method of claim 1 wherein said at least one alkanolamine salt is at least one mono-, di-, or tri-ethanolamine salt.

3. The method of claim 1 wherein said at least one salt is added in an amount of about 0.01 to 15% by weight of the semiamide acid, based upon the weight of said aqueous system.

4. The method of claim 2 wherein said at least one salt is added an amount of about 0.01 to 15% by weight of the semiamide acid, based upon the weight of said aqueous system.

5. The method of claim 1 wherein said at least one salt is added an amount of about 0.05 to 1% by weight of the semiamide acid, based upon the weight of said aqueous system.

6. The method of claim 2 wherein said at least one salt is added an an amount of about 0.05 to 1% by weight of the semiamide acid, based upon the weight of said aqueous system.

* * * * *